US007591112B2

(12) United States Patent
Verheyen

(10) Patent No.: US 7,591,112 B2
(45) Date of Patent: Sep. 22, 2009

(54) COMPACT ROOF-COVERING SYSTEM

(75) Inventor: Stefaan Verheyen, Hove (BE)

(73) Assignee: Umicore, Brussels (BE)

( * ) Notice: Subject to any disclaimer, the term of this patent is extended or adjusted under 35 U.S.C. 154(b) by 625 days.

(21) Appl. No.: 10/515,194

(22) PCT Filed: May 21, 2003

(86) PCT No.: PCT/EP03/50182

§ 371 (c)(1),
(2), (4) Date: Sep. 14, 2005

(87) PCT Pub. No.: WO03/100189

PCT Pub. Date: Dec. 4, 2003

(65) Prior Publication Data

US 2006/0096211 A1 May 11, 2006

(30) Foreign Application Priority Data

May 23, 2002 (EP) ..... 02077018

(51) Int. Cl.
*E04B 1/74* (2006.01)

(52) U.S. Cl. ..... 52/407.2; 52/407.3; 52/407.4; 52/309.7; 52/309.16; 52/408; 52/506.05; 52/404.3

(58) Field of Classification Search ..... 52/407.1, 52/407.2, 407.3, 407.4, 309.2, 309.7, 309.11, 52/309.16, 408, 409, 410, 506.05, 404.3, 52/746.11, 309.8
See application file for complete search history.

(56) References Cited

U.S. PATENT DOCUMENTS 3,411,256 A 11/1968 Best
3,466,222 A * 9/1969 Curtis ..... 428/142
3,694,306 A * 9/1972 Fricklas ..... 428/341
3,763,614 A 10/1973 Hyde et al.
4,446,665 A * 5/1984 Berger ..... 52/407.4
4,558,550 A * 12/1985 Marchais et al. ..... 52/309.7
4,566,239 A * 1/1986 Smigel et al. ..... 52/407.4
4,602,468 A * 7/1986 Simpson ..... 52/410
4,707,961 A * 11/1987 Nunley et al. ..... 52/408
4,736,552 A * 4/1988 Ward et al. ..... 52/94
4,744,187 A 5/1988 Tripp
4,833,853 A 5/1989 Deibele et al.

FOREIGN PATENT DOCUMENTS

| | | |
|---|---|---|
| DE | 2162386 | 6/1973 |
| DE | 195 45 431 | 6/1997 |
| EP | 0 903 448 | 3/1999 |
| FR | 2 701 049 | 8/1994 |
| FR | 2 713 687 | 6/1995 |

* cited by examiner

*Primary Examiner*—Richard E Chilcot, Jr.
*Assistant Examiner*—Chi Q Nguyen
(74) *Attorney, Agent, or Firm*—Brinks Hofer Gilson & Lione

(57) ABSTRACT

A covering system for roofs and for the outside of building walls is provided in which, on top, a high range of various decorative materials and elements can be fixed without penetrating the watertight layer. The system contains protruding elements connected to the support and flexible watertight membranes arranged so as to cover and contact essentially the complete support surface, including the protruding elements. Panels, preferably rigid insulation panels with excellent resistance to water, are arranged so as to hold down the watertight membranes onto the support, thus protecting the membrane from thermal cycling, UV rays and physical damage. The panels can be fixed with non-penetrating fastening means to secure the complete system to the protruding elements and to the support.

12 Claims, 3 Drawing Sheets

COMPACT ROOF-COVERING SYSTEM

FIELD

Figure 1:
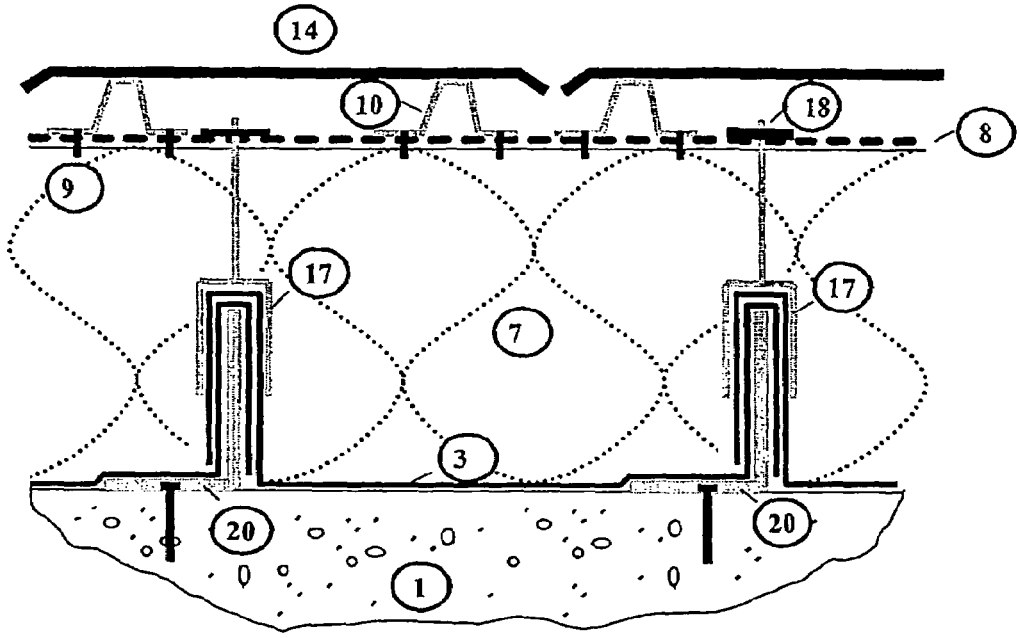

The invention relates to watertight roof constructions of the inverted roof type. Most traditional sloped roofs are constructed with a multifunctional outer surface layer, the covering. For such roofs, the covering materials provide for a watertight surface and also ensure to a certain degree a decorative function. The combination of requirements results in restrictions in the choice of cover materials, arrangement of cover elements, roof shapes and slopes.

BACKGROUND

In traditional roofs, two common alternatives are known: the double skin roof and the inverted roof. In FR 2713687, U.S. Pat. Nos. 3,411,256 and 3,763,614 illustrations are given of double skin and inverted roofs.

Double skin roofs consist essentially of a support, an insulation layer, a watertight membrane, a secondary support and a decorative layer. Since in such a system the watertight membrane is hidden, it is difficult, in case of water leaks, to localize the infiltration and to repair it. Notwithstanding this, most double skin systems use penetrating fixings, thus increasing the risk for water leaks. Another disadvantage of the system is caused by the penetrating fixings, which form thermal bridges and increase the internal condensation risk. Internal condensation has a deleterious effect on the life of the roof. Reducing the number of fixings has consequences towards the dimensions of the fixings, possibly causing larger thermal bridges. Other disadvantages are the fact that the decorative layer always needs a secondary metal support and the fact that double skin roofs mostly are characterized by a thick build-up of layers.

The inverted roof, also known as upside down roof, was initially developed for flat roof construction. In general, insulation can be incorporated into a flat roof construction, either over or under the watertight membrane of the roof. Where the insulation system is placed on top of the watertight membrane, this is usually referred to as an inverted roof. Such a roof protects the watertight membrane from thermal cycling, effects of UV rays, weathering and physical damage. In a conventional inverted roof, the insulation is provided by foamed slabs, which are placed on top of the watertight membrane. To prevent the slabs of being blown away, or floated off, it is necessary to anchor them in place. In general, it is not possible to use mechanical fixings since such fixings normally would penetrate the watertight membrane, causing leaks. Conventionally, the insulation slabs are laid loosely on top of the watertight membrane on a flat roof; ballast with gravel or paving slabs are further added, for an additional loading of at least 50 kg/m$^2$. This type of construction certainly cannot be described as lightweight. Also, the use of such a conventional inverted roof is restricted to low roof slopes: due to the absence of fixings, there is no resistance against sliding of the insulation and of the ballast layer.

SUMMARY

The present invention addresses the problem of providing a roof construction that minimizes the risk of water leaks, that has a compact build-up, that retains the advantages of the inverted roof and that still allows for the use of a broad range of decorative elements and materials. The invention also addresses the problem of providing simplicity of installation with a mid number of parts, and the need to keep the installation inexpensive by minimizing labor cost. The invention can be used for all roof slopes between 0° and 90°. This means that vertical parts, such as building walls, and horizontal parts, such as flat roofs and gutters, can be covered with the invented system. The invention is particularly interesting for roofs with a slope larger than 0° and smaller than 90°.

According to the invention, there is provided an inverted roof comprising

- a support, defining the surface to be covered;
- one or more protruding elements connected to the support;
- one or more flexible watertight membranes arranged so as to cover and contact essentially the complete surface to be covered, and covering the protruding elements; and
- one or more panels of thermal insulating material;

where the panels press the watertight membranes against the support, and are secured to the protruding elements by fastening means. In one particular embodiment, to hold down the membranes, the panels cover and contact essentially the complete surface of the watertight membranes.

The support can be a wood deck, a layer of concrete or a steel frame. The protruding elements preferably consist of linear members connected along their longest dimension to the support in a direction parallel to the expected water flow. This configuration avoids water build-up and stagnation alongside these linear members. Protruding elements may also consist of punctual members, or a combination of linear and punctual members. The use of linear members offers some benefits towards the watertight membranes, as illustrated below, but special attention is needed to avoid water stagnation behind them. The use of punctual members does not require this attention, but needs special prefabricated watertight membranes.

One or more flexible watertight membranes are placed over the protruding elements and the support. The watertight membranes may consist of strips, sheets or special prefabricated sheets. In this text, strips are understood as being oblong membranes, typically available on reels. Sheets are understood as large-surface covering membranes, directly produced as such or consisting of several strips, pre-assembled in the workshop. Special prefabricated sheets are described as membranes with protuberances, pre-formed in the workshop. The watertight membranes can be placed without bonding adhesives onto the support. This keeps the installation inexpensive by minimising labour costs and facilitates the separate recycling of all materials used.

When linear protruding elements are used, it is possible to use two or more watertight membranes in the form of adjacent strips. The overlaps of the watertight membranes are preferably situated on the linear protruding members, thus forming standing seams. Overlaps with standing seam are easier to execute and are less critical towards water infiltration than conventional overlaps. Standing seams need fewer efforts than conventional overlaps for an equal or even higher water sealing quality.

When punctual protruding elements are used, special prefabricated sheets with pre-assembled protuberances are arranged so that each protuberance fits exactly over each punctual protruding element. When a combination of linear and punctual protruding elements is chosen, the use of prefabricated sheets can be combined with the use of standing seams.

The flexible watertight membranes preferably consist of a synthetic material with a primary watertight function such as EPDM rubber (Ethylene Propylene Diene Methylene Terpolymer), PVC (polyvinyl chloride), or CPE (chlorinated polyethylene). They may also consist of non-UV resistant watertight material Such as PE (polyethylene). A membrane thickness of less than 0.8 mm is advantageous as this facilitates its placement while being lighter and cheaper.

Onto the protruding elements and watertight membranes, panels are posed. The fastening mean protect the panels from wind uplift, water uplift and sliding. The fastening weans preferably do not penetrate the watertight membranes, since this always creates an extra risk for water leaks. When penetrating fastening means are used, they need special attention to preserve the water sealing function. This can be achieved by using relatively high protruding elements, allowing to position the penetration holes 4-10 cm above the plane defined by the watertight membranes. Depending upon the type of the panels, different fastening means can be used.

The panels covering the watertight membranes consist of thermal insulating material such as extruded (XPS) or expanded (EPS) polystyrene, cellular glass or Mineral wool board. This way, the panels protect the watertight membranes from uplift, thermal cycling, UV rays and physical damage.

The fastening means securing the panels to the protruding elements advantageously consist of synthetic material, preferably with a thermal conductivity of less than 0.4 W/m/K. This avoids the formation of cold bridges.

When using panels with relative high pull-off resistance Such as XPS, in particular XPS panels coated with a UV resistant layer, they can be relied upon as a basis to affix other structures, for instance decorative elements connected to the XPS panels by screws.

Panels with relative low pull-off resistance, such as water and weather resistant mineral wool or EPS, are preferably covered with one ore more sections of wire net, which can be secured to the protruding elements. The wire net preferably consists of woven metal wire. The decorative structures can be affixed to this wire net.

The decorative structures are preferably fixed without penetrating the watertight membranes. This outer structure only has an aesthetic function, the water sealing function being ensured by the watertight membranes. Decorative elements made out of unconventional materials can be used, as the joints between the elements do not need to be watertight.

Glue or any other type of adhesive material can be applied to help in fixing the membranes to the support, the overlapping membranes to each other or the panels to the watertight membranes. An adhesive-free design is however preferred.

The present invention is characterised by freedom of choice. All of the following items can be combined:

- different kinds of base supports: wood, metal or concrete;
- linear or punctual protruding elements;
- flexible watertight membranes in the shape of strips, sheets or specially prefabricated sheets;
- water and weather resistant panels with high pull-off resistance or not;
- decorative material fixed with use of spacers, with use of a secondary metal work, with direct fixation onto the protruding elements or with direct fixation onto the panels or net.

DETAILED DESCRIPTION

Several embodiments of the invention will now be described by way of example, with reference to the drawings.

FIG. 1 shows a transversal section of a concrete deck with linear protruding elements. The watertight membranes consist of strips with double overlaps and standing seam. Over the water and weather resistant insulation, a net is connected to the protruding elements without penetrating the watertight membranes. The decorative material is fixed onto the net.

Figure 2:
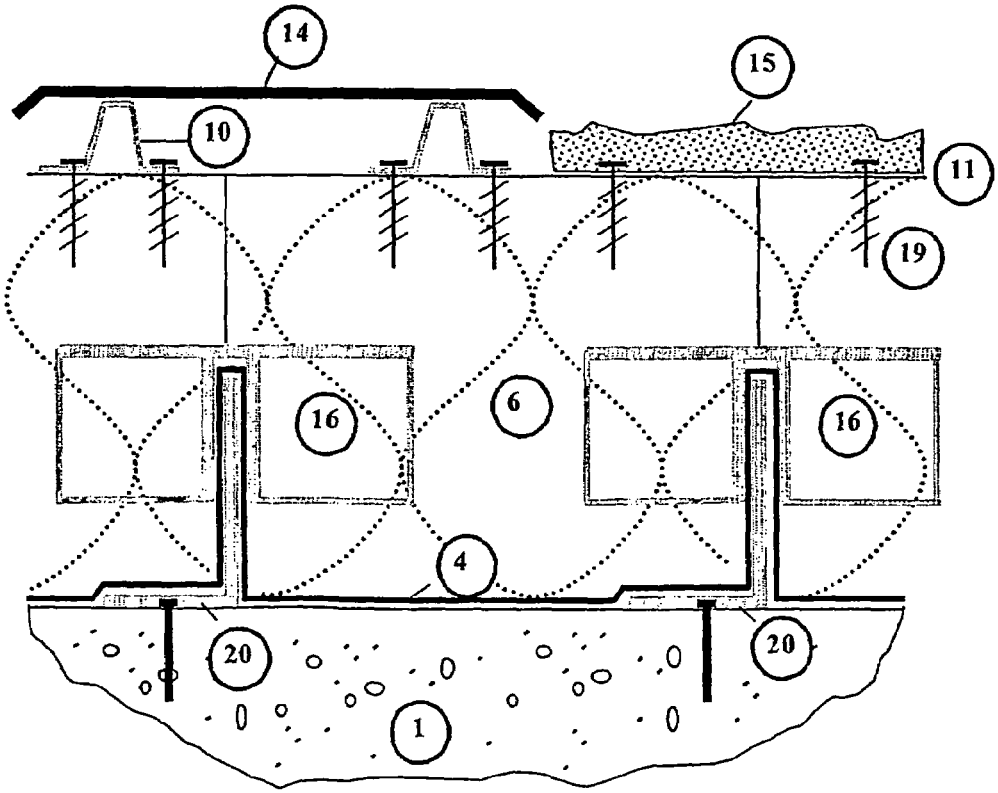

FIG. 2 shows a transversal section of a concrete deck with linear protruding elements. The watertight membranes consist of a sheet overlapping the protruding elements. The water and weather resistant insulation is connected to the protruding elements without penetrating the watertight membrane. The decorative material is fixed directly into the rigid insulation material.

Figure 3:
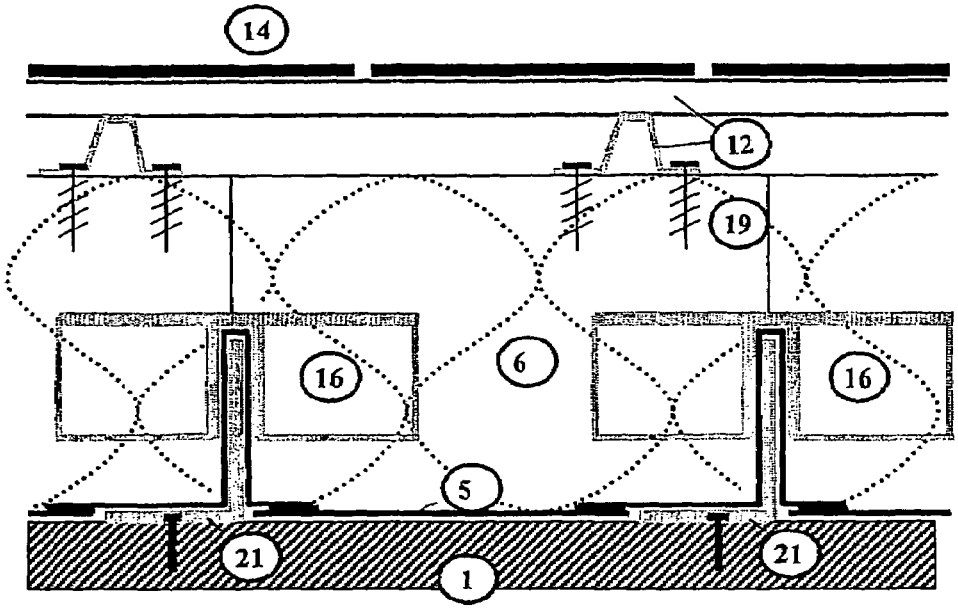

FIG. 3 shows a transversal section of a wood deck with punctual protruding elements. The watertight membrane consists of special prefabricated sheets encapsulating the protruding elements. The water and weather resistant insulation is connected to the protruding elements without penetrating the watertight membrane. The decorative material is fixed onto a secondary support fixed directly into the rigid insulation material.

Figure 4:
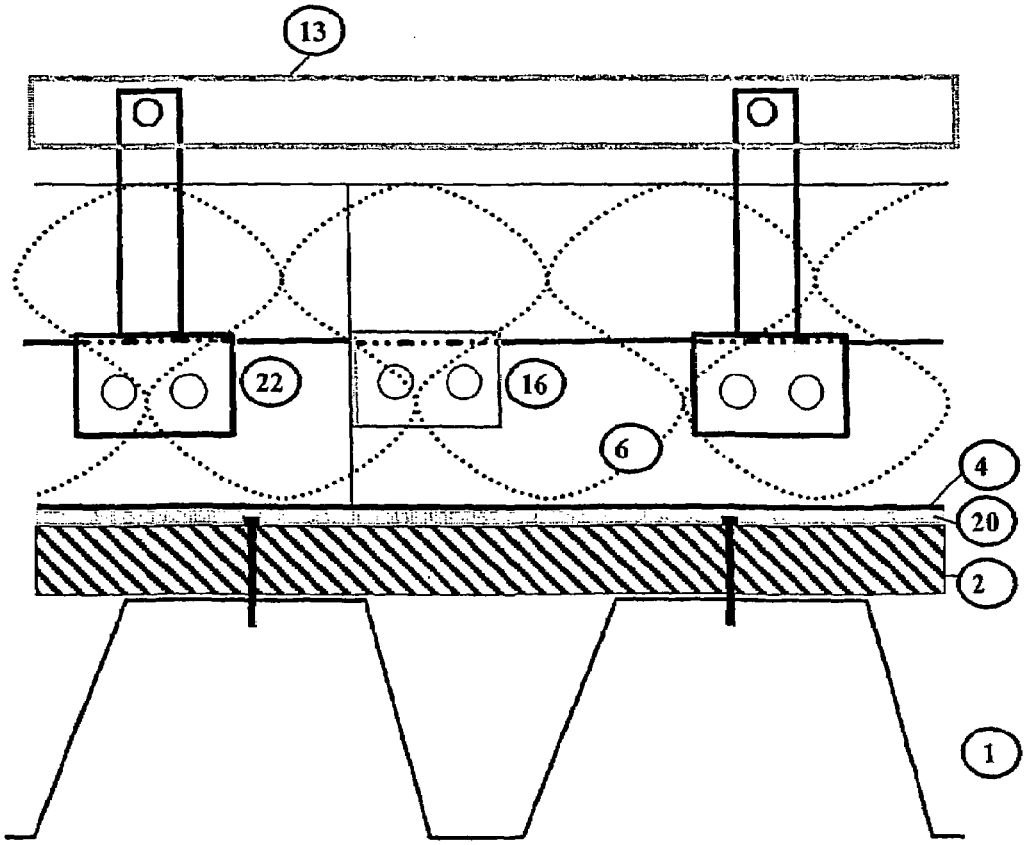

FIG. 4 shows a longitudinal section of a metal deck with a supplementary layer and linear protruding elements perpendicular to the steel deck valleys. The water and weather resistant insulation is connected to the protruding elements without penetrating the watertight membrane. Likewise, the decorative material is fixed with direct connectors onto to the protruding elements without penetrating the watertight membrane.

Figure 5:
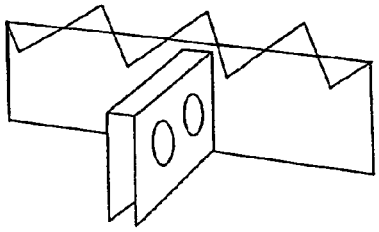

FIG. 5 details the fastening means 'type A' (16) shown in FIGS. 2, 3 and 4.

Figure 6:
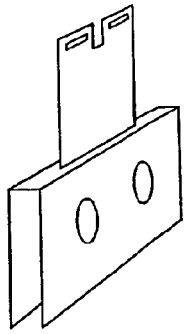

FIG. 6 details the fastening means 'type B' (17) shown in FIG. 1.

Figure 7:
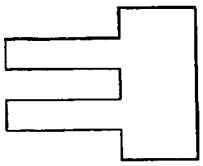

FIG. 7 details the fastening clip (18) shown in FIG. 1.

Figure 8:
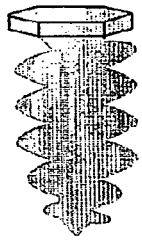

FIG. 8 details the special screw (19), shown in FIGS. 2 and 3.

Figure 9:
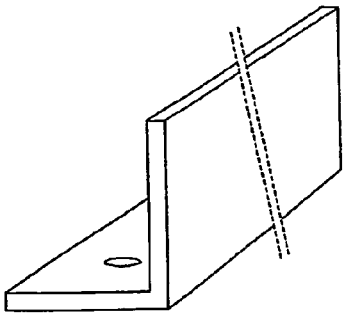

FIG. 9 details the linear protruding element (20) shown in FIGS. 1, 2 and 4.

Figure 10:
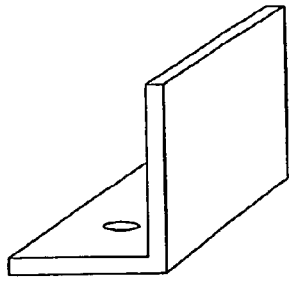

FIG. 10 details the punctual protruding element (21), shown in FIG. 3.

Figure 11:
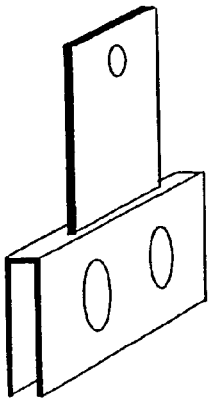

FIG. 11 details a direct connector (22) shown in FIG. 4.

For the base deck (1), also called the support, wood, steel and concrete can be used. FIGS. 1 and 2 show a concrete deck (1). FIG. 3 shows a wood deck and FIG. 4 a metal deck (1). All deck constructions have been chosen by way of illustration and are usable in any combination. When using a metal deck, as shown in FIG. 4, a supplementary layer (2) is needed to offer a continuous supporting surface. This layer can be metal, plywood or insulation material, and can be loose laid.

On the base deck (1) or on the supplementary layer (2), linear protruding elements (20) or punctual protruding elements (21) are mechanically connected. Such type of elements can be also found in U.S. Pat. Nos. 4,744,187 and 4,833,853.

Linear protruding elements (20) can be L- or U-shaped profiles with a height and a base of about 3-10 cm. A partially closed U-shape, allowing for the insertion and retention of the head of suitably shaped bolts used for securing the panels, is well adapted: it results in a structurally stable system while any penetration of the watertight membrane is avoided. The dimensions of the linear protruding elements, their axial distance and the number of fixations into the deck are function of the expected physical forces and of the properties of all materials utilised. Typically, the height of the linear protruding elements will be around 4 cm. The linear protruding elements are placed in-line, maintaining gaps of about 2-5 mm between co-linear elements. Normally, an axial distance of 40-120 cm is used. However, particular roof shapes can be executed by following upwardly convergent lines.

Punctual protruding elements (21) can be short L-shaped profiles with a height and a base of 3-10 cm. The dimensions of the punctual protruding elements, their two dimensional axial distance and the number of fixations into the deck, are function of the expected physical forces and of the properties of all materials utilised. Typically, the height of the linear protruding elements will be around 4 cm. Due to their limited length, their positioning is not critical in view of the water flow. The protruding elements can be placed according to a regular pattern, with an axial distance of 40-120 cm.

Any combination of linear and punctual protruding elements can also be envisaged.

Flexible watertight-membranes consisting of strips (3), sheets (4) or special prefabricated sheets (5) ensure the water sealing function of the roof. The material of the watertight membranes can be EPDM rubber, PVC or other. The watertight membranes can be loose laid or bonded onto the base deck (1, 2).

When linear protruding elements (20) are used, the longitudinal overlaps of the watertight membranes (as in 3) are preferably situated on the linear protruding elements, thus forming standing seams with double overlap, as in FIG. 1. Provided that the height of the standing seam is sufficient and that capillarity is avoided, the overlaps can even be made watertight without any sealer.

Horizontal overlaps can also be accepted (as in 5), although they create a higher leak risk than standing seams. Transversal horizontal overlaps can be avoided by using long watertight membranes from gutter to hip. Horizontal overlaps of the watertight membranes can be made watertight with the traditional treatment and techniques developed by the manufacturers of the membranes, such as fohning, seaming or sealing.

The wind uplift resistance of the watertight membranes (3,4,5) is ensured by the particular positioning of the insulation panels (6, 7). The insulation panels have to be rigid, waterproof and weatherproof, and may provide excellent thermal insulation. If directly subjected to UV rays, the insulation panels should be resistant by themselves or protected by a special coating. For XPS, the panels should be protected on top by an external thin armature coated with a thin UV resistant layer.

For this invention the panels can be divided into two groups:

- water- and weatherproof insulation with enough reliable pull-off resistance (6) such as e.g. XPS as illustrated in FIGS. 2, 3 and 4;
- water- and weatherproof insulation without enough reliable pull-off resistance (7) such as e.g. certain types of mineral wool and certain types of EPS (expanded polystyrene), as illustrated in FIG. 1.

In both cases, the insulation panels cover the watertight membranes completely, thus protecting them from UV rays, thermal cycling and physical damage during execution and thereafter. This implies that their thickness exceeds the height of the protruding elements. The insulation panels preferably fully contact the watertight layer (3,4,5), preventing wind uplift. The insulation panels can be loose laid without use of adhesives.

The water- and weatherproof insulation panels (6, 7) are mechanically secured to the protruding elements (20, 21) by fastening means 'type A' (16) or 'type B' (17). FIGS. 2, 3 and 4 show water- and weatherproof insulation with enough reliable pull-off resistance (6). In this case, the panels are directly connected onto the protruding elements (20, 21) by fastening means 'type A' (16), and fixed to the protruding elements, preferably without penetrating the watertight membranes. The fastening means 'type A' are preferably made of stainless or galvanised steel and placed at each joint of the insulation panels.

FIG. 1 shows water- and weatherproof insulation without enough reliable pull-off resistance (7). In this case, before placing the panels, fastening means 'type B' (17) are fixed to the protruding elements, preferably without penetrating the watertight membranes. Next, the panels are posed between the fastening means 'type B' (17). The panels are secured by posing a metal net (8) on top. The fastening means 'type B' (17) are normally made of stainless steel or galvanised steel, their quantity being chosen according to the expected climate and the properties of the net. The net is mechanically connected to the protruding fastening means 'type B' with fastening clips (18). The net (8) preferably consists of stainless steel wire with a thickness chosen according to the needed pull-off resistance. Net sections with a length of 100 cm and a width slightly larger than the axial distance of the protruding elements are easy to handle and to fix, while resistant overlaps are obtained.

The top layer can consist of all kinds of decorative elements: rigid panels (13), small rigid elements (14) or blankets (15) made of materials like wood, metal, plastic or even grass. The only restriction is the weight and the expansion coefficient. If a net (8) is used, the decorative elements can be fixed onto the net with traditional means (9) like clips, without penetrating the watertight membranes. An air gap can be created with use of spacers (10) or with use of secondary metal work (12).

If a water- and weatherproof insulation with enough reliable pull-off resistance (6) is used, the decorative elements can be fixed onto the insulation panels with special screws (19), without penetrating the watertight membrane. An air gap can be created with use of spacers (10) or with use of secondary metal work (12). The decorative elements can also be fixed without air gap (11). The special screws (19) cooperate with the XPS panels so as to provide high pull-off resistance.

In a special embodiment, the decorative elements need to be fixed directly onto the protruding elements as shown in FIG. 4 with connectors (22) as in FIG. 11.

The invention claimed is:

1. An inverted roof, comprising:

a support, defining a surface to be covered;

one or more protruding elements connected to the support;

one or more flexible watertight membranes arranged to cover and contact essentially the complete surface to be covered and to cover the protruding elements; and one or more panels of thermal insulating material;

wherein the panels press the watertight membranes against the support and are secured to the protruding elements by fastening means and wherein the fastening means do not penetrate the one or more watertight membranes.

2. The inverted roof according to claim 1, wherein the one or more panels cover and contact essentially the complete surface of the watertight membranes.

3. The inverted roof according to claim 1, wherein the one or more protruding elements are linear members having a longest dimension, the linear members being connected along their longest dimension to the support in a direction parallel to water flow.

4. The inverted roof according to claim 3, wherein at least two watertight membranes are shaped as adjacent strips having edges, the adjacent strips being arranged with their edges overlapping along the linear members.

5. The inverted roof according to claim 1, wherein the one or more watertight membranes consist of synthetic material.

6. The inverted roof according to claim 5, wherein the one or more watertight membranes have a thickness of less than 0.8 mm.

7. The inverted roof according to claim 1, wherein the thermal insulating material is extruded or expanded polystyrene, cellular glass, or mineral wool board.

8. The inverted roof according to claim 7, wherein the extruded polystyrene panels are coated with a UV resistant layer.

9. The inverted roof according to claim 7, wherein the extruded polystyrene panels are used as a basis to affix other structures.

10. The inverted roof according to claim 9, wherein the other structures are connected to the extruded polystyrene panels by screws.

11. The inverted roof according to claim 1, wherein the fastening means consist of synthetic material.

12. The inverted roof according to claim 11, wherein the synthetic material has a thermal conductivity of less than 0.4 W/m/K.

* * * * *

UNITED STATES PATENT AND TRADEMARK OFFICE

CERTIFICATE OF CORRECTION

PATENT NO. : 7,591,112 B2
APPLICATION NO. : 10/515194
DATED : September 22, 2009
INVENTOR(S) : Stefaan Verheyen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1043 days.

Signed and Sealed this

Twenty-first Day of September, 2010

David J. Kappos

David J. Kappos
*Director of the United States Patent and Trademark Office*